United States Patent [19]

Wedding et al.

[11] 4,126,809

[45] Nov. 21, 1978

[54] GAS DISCHARGE DISPLAY PANEL WITH LANTHANIDE OR ACTINIDE FAMILY OXIDE

[75] Inventors: Donald K. Wedding, Toledo; Roger E. Ernsthausen, Luckey; Bernard W. Byrum, Jr.; Michael E. Fein, both of Toledo, all of Ohio

[73] Assignee: Owens-Illinois, Inc., Toledo, Ohio

[21] Appl. No.: 581,064

[22] Filed: May 27, 1975

Related U.S. Application Data

[60] Continuation of Ser. No. 556,777, Mar. 10, 1975, abandoned, and Ser. No. 571,902, Apr. 24, 1975, abandoned, said Ser. No. 556,777, is a continuation-in-part of Ser. No. 417,961, Nov. 21, 1973, abandoned, which is a continuation-in-part of Ser. No. 300,784, Oct. 25, 1972, abandoned, which is a division of Ser. No. 249,207, May 1, 1972, abandoned, which is a continuation-in-part of Ser. No. 173,294, Aug. 19, 1971, abandoned, said Ser. No. 571,902, is a continuation-in-part of Ser. No. 299,226, Oct. 20, 1972, abandoned, which is a division of Ser. No. 173,251, Aug. 19, 1971, abandoned.

[51] Int. Cl.[2] ..... H01J 61/30

[52] U.S. Cl. ..... 313/221; 313/188; 313/220

[58] Field of Search ..... 313/188, 201, 220, 221

[56] References Cited

U.S. PATENT DOCUMENTS 3,814,970 6/1974 Reboul ..... 313/221

*Primary Examiner*—Rudolph V. Rolinec
*Assistant Examiner*—Darwin R. Hostetter
*Attorney, Agent, or Firm*—Richard D. Heberling; Myron E. Click; David H. Wilson

[57] ABSTRACT

A gas discharge device containing at least two electrodes is shown, at least one of the electrodes being insulated from the gas by at least one dielectric insulating member containing a predetermined beneficial amount of an oxide of at least one lanthanide series rare earth metal or at least one actinide series rare earth metal. In one embodiment, a multiple gaseous discharge display/memory panel having an electrical memory and capable of producing a visual display is used, the panel having an ionizable gaseous medium in a gas chamber, formed by a pair of opposed dielectric material charge storage members, each of which is respectively backed by an array of electrodes, the electrodes behind each dielectric member being oriented with respect to the electrodes behind the opposing member so as to define a plurality of discrete discharge volumes constituting a discharge unit. Each opposing dielectric surface is coated with a metal oxide of the lanthanide rare earth series or the actinide rare earth series.

12 Claims, 9 Drawing Figures

AGING CHARACTERISTICS
YBa2 O3 SURFACE

LEGEND
A IS AN ACTINIDE RARE EARTH OXIDE CONTAINING LAYER ON DIELECTRIC MEMBERS 10 AND 11

LEGEND
A' IS AN ACTINIDE RARE EARTH OXIDE SOURCE CONTAINED WITHIN DIELECTRIC MEMBER 10

GAS DISCHARGE DISPLAY PANEL WITH LANTHANIDE OR ACTINIDE FAMILY OXIDE

RELATED APPLICATIONS

This application is a continuation of U.S. appln. Ser. No. 556,777, filed Mar. 10, 1975, now abandoned and U.S. appln. Ser. No. 571,902, filed Apr. 24, 1975, now abandoned. The above-mentioned appln. Ser. No. 556,777 is a continuation-in-part appln. of appln. Ser. No. 417,961, filed Nov. 21, 1973, now abandoned. The above-mentioned appln. Ser. No. 417,691 is a C-I-P of previously copending and now abandoned U.S. patent appln. Ser. No. 300,784, filed Oct. 25, 1972; which is a division of previously copending and now abandoned U.S. patent appln. Ser. No. 249,207, filed May 1, 1972; which is a C-I-P of previously copending and now abandoned U.S. patent appln. Ser. No. 173,294, filed Aug. 19, 1971.

The above-mentioned Ser. No. 571,902, filed Apr. 24, 1975, is a C-I-P appln. of pending appln. Ser. No. 299,226, filed Oct. 20, 1972, now abandoned. Ser. No. 299,226 is a division of previously copending and now abandoned U.S. patent appln. Ser. No. 173,251, filed Aug. 19, 1971.

BACKGROUND OF THE INVENTION

This invention relates to novel multiple gas discharge display/memory panels or units which have an electrical memory and which are capable of producing a visual display or representation of data such as numerals, letters, television display, radar displays, binary words, etc.

Multiple gas discharge display and/or memory panels of one particular type with which the present invention is concerned are characterized by an ionizable gaseous medium, usually a mixture of at least two gases at an appropriate gas pressure, in a thin gas chamber or space between a pair of opposed dielectric charge storage members which are backed by conductor (electrode) members, the conductor members backing each dielectric member typically being appropriately oriented so as to define a plurality of discrete gas discharge units or cells.

In some prior art panels the discharge cells are additionally defined by surrounding or confining physical structure such as apertures in perforated glass plates and the like so as to by physically isolated relative to other cells. In either case, with or without the confining physical structure, charges (electrons, ions) produced upon ionization of the elemental gas volume of a selected discharge cell, when proper alternating operating potentials are applied to selected conductors thereof, are collected upon the surfaces of the dielectric at specifically defined locations and constitute an electrical field opposing the electrical field which created them so as to terminate the discharge for the remainder of the half cycle and aid in the initiation of a discharge on a succeeding opposite half cycle of applied voltage, such charges as are stored constituting an electrical memory.

Thus, the dielectric layers prevent the passage of substantial conductive current from the conductor members to the gaseous medium and also serve as collecting surfaces for ionized gaseous medium charges (electrons, ions) during the alternate half cycles of the A.C. operating potentials, such charges collecting first on one elemental or discrete dielectric surface area and then on an opposing elemental or discrete dielectric surface area on alternate half cycles to constitute an electrical memory.

An example of a panel structure containing non-physically isolated or open discharge cells is disclosed in U.S. Pat. No. 3,499,167 issued to Theodore C. Baker, et al.

An example of a panel containing physically isolated cells is disclosed in the article by D. L. Bitzer and H. G. Slottow entitled "The Plasma Display Panel — A Digitally Addressable Display With Inherent Memory", Proceeding of the Fall Joint Computer Conference, IEEE, San Francisco, California, November 1966, pages 541–547. Also reference is made to U.S. Pat. No. 3,559,190, issued to Bitzer et al.

In the construction of the panel, a continuous volume of ionizable gas is confined between a pair of dielectric surfaces backed by conductor arrays typically forming matrix elements (or crossed networks). The two conductor arrays may be orthogonally related sets of parallel lines (but any other configuration of conductor arrays may be used). The two arrays define at their intersections a plurality of opposed pairs of charge storage areas on the surfaces of the dielectric bounding or confining the gas. Thus, for a conductor matrix having H rows and C columns the number of elemental or discrete areas will be twice the number of elemental discharge cells.

In addition, the panel may comprise a so-called monolithic structure in which the conductor arrays are created on a single substrate and wherein two or more arrays are separated from each other and from the gaseous medium by at least one insulating member. In such a device the gas discharge takes place not between two opposing elemental areas on two different substrates, but between two contiguous or adjacent elemental areas on the same substrate; the gas being confined between the substrate and an outer retaining wall.

It is also feasible to have a gas discharge device wherein some of the conductive or electrode members are in direct contact with the gaseous medium and the remaining electrode members are appropriately insulated from such gas, i.e., at least one insulated electrode.

In addition to the matrix configuration, the conductor arrays may be shaped otherwise. Accordingly, while the preferred conductor or electrode arrangement is orthogonal and of the crossed grid (or network) type as discussed herein, it is likewise apparent that where a maximal variety of two dimensional display patterns is not necessary, as where specific standardized visual shapes (e.g., numerals, letters, words, etc.) are to be formed and image resolution is not critical, the conductors may be shaped accordingly (e.g., a segmented digit display).

The gas is selected to produce visible light and invisible radiation. which may be used to stimulate a phosphor (if visual display is an objective) and a copious supply of charges (ions and electrons) during discharge.

In the prior art, a wide variety of gases and gas mixtures have been utilized as the gaseous medium in a number of different gas discharge devices. Typical of such gases include pure gases and mixtures of CO; $CO_2$; halogens; nitrogen; $NH_3$; oxygen; water vapor; hydrogen; hydrocarbons; $P_2O_5$; boron fluoride; acid fumes; $TiCl_4$; air; $H_2O_2$; vapors of sodium, mercury, thallium, cadmium, rubidium, and cesium; carbon disulfide; $H_2S$; deoxygenated air; phosphorus vapors; $C_2H_2$; $CH_4$; naphthalene vapor; anthracene; freon; ethyl alcohol; methylene bromide; heavy hydrogen; sulfur hexafluoride; tritium; radioactive gases; and the so-called rare or inert Group VIII gases.

It will be understood that the basic electrical phenomenon utilized in this invention is the generation of charges (ions and electrons) alternately storable at pairs of opposed or facing discrete points or areas on a pair of dielectric surfaces backed by conductors connected to a source of operating potential. Such stored charges result in an electrical field opposing the field produced by the applied potential that created them and hence operate to terminate ionization in the elemental gas volume between opposed or facing discrete points or areas of dielectric surface. The term "sustain a discharge" means producing a sequence of momentary discharges, at least one discharge for each half cycle of applied alternating sustaining voltage, once the elemental gas volume has been fired, to maintain alternate storing of charges at pairs of opposed discrete areas on the dielectric surfaces.

The term "memory margin" is defined herein as $$M.\,M. = \frac{V_f - V_E}{V_f/2}$$

where $V_f$ is the peak-to-peak half amplitude of the smallest sustaining voltage signal which results in a discharge every half cycle, but at which the cell is not bi-stable and $V_E$ is the half amplitude of the minimum applied voltage sufficient to sustain discharges once initiated.

As used herein, a cell is in the "on state" when a quantity of charge is stored in the cell such that on each half cycle of the sustaining voltage, a gaseous discharge is produced.

In addition to the sustaining voltage, other voltages may be utilized to operate the panel, such as firing, addressing, and writing voltages.

A "firing voltage" is any voltage, regardless of source, required to discharge a cell. Such voltage may be completely external in origin or may be comprised of internal cell wall voltage in combination with externally originated voltages.

An "addressing voltage" is a voltage produced on the panel X-Y electrode coordinates such that at the selected cell or cells, the total voltage applied across the cell is equal to or greater than the firing voltage whereby the cell is discharged.

A "writing voltage" is an addressing voltage of sufficient magnitude to make it probable that on subsequent sustaining voltage half cycles, the cell will be in the "on state".

In the operation of a multiple gaseous discharge device of the type described hereinbefore, it is necessary to condition the discrete elemental gas volume of each discharge cell by supplying at least one free electron thereto such that a gaseous discharge can be initiated when the cell is addressed with an appropriate voltage signal.

The prior art has disclosed and practiced various means for conditioning gaseous discharge cells.

One such means of panel conditioning comprises a so-called electronic process whereby an electronic conditioning signal or pulse is periodically applied to all of the panel discharge cells, as disclosed, for example, in British patent specification No. 1,161,832, page 8, lines 56 to 76. Reference is also made to U.S. Pat. No. 3,559,190 and "The Device Characteristics of the Plasma Display Element" by Johnson, et al., IEEE Transactions On Electron Devices, September, 1971. However, electronic conditioning is self-conditioning and is only effective after a discharge cell has been previously conditioned; that is, electronic conditioning involves periodically discharging a cell and is therefore a way of maintaining the presence of free electrons. Accordingly, one cannot wait too long between the periodically applied conditioning pulses since there must be at least one free electron present in order to discharge and condition a cell.

Another conditioning method comprises the use of external radiation, such as flooding part or all of the gaseous medium of the panel with ultraviolet radiation. This external conditioning method has the obvious disadvantage that it is not always convenient or possible to provide external radiation to a panel, especially if the panel is in a remote position. Likewise, an external UV source requires auxiliary equipment. Accordingly, the use of internal conditioning is generally preferred.

One internal conditioning means comprises using internal radiation, such as by the inclusion of a radioactive material.

Another means of internal conditioning, which we call photon conditioning, comprises using one or more so-called pilot discharge cells in the on-state for the generation or photons. This is particularly effective in a so-called open cell construction (as described in the Baker, et al. patent) wherein the space between the dielectric surfaces occupied by the gas is such as to permit photons generated on discharge in a selected discrete or elemental volume of gas (discharge cell) to pass freely through the panel gas space so as to condition other and more remote elemental volumes of other discharge units. In addition to or in lieu of the pilot cells, one may use other sources of photons internal to the panel.

Internal photon conditioning may be unreliable when a given discharge unit to be addressed is remote in distance relative to the conditioning source, e.g., the pilot cell. Accordingly, a multiplicity of pilot cells may be required for the conditioning of a panel having a large geometric area. In one highly convenient arrangement, the panel matrix border (perimeter) is comprised of a plurality of such pilot cells.

THE INVENTION

In accordance with the practice of this invention, there is incorporated into the dielectric a beneficial amount of a source of at least one Lanthanide Series rare-earth metal or at least one Actinide Series rare-earth metal.

The Lanthanide Series rare-earth metals are defined as lanthanum, cerium, praseodymium, neodymium, promethium, samarium, europium, gadolinium, terbium, dysprosium, holmium, erbium, thulium, ytterbium, lutetium, scandium and yttrium.

Although scandium and yttrium are not classified among the Lanthanide Series rare-earth elements in Mendeleev's Table of the Periodic Arrangement of the Elements, these two elements, especially yttrium, sometimes exhibit the same properties as the rare-earth series. Accordingly, such as included in the classification given in this specification.

Typical rare-earth compounds include:

Lanthanum acetate, lanthanum phosphide, lanthanium bromate, lanthanum hexaboride, lanthanum bromide, lanthanum chloride, lanthanum carbide, lanthanum boride, lanthanum nitride, lanthanum nitrate, lanthanum fluoride, lanthanum sulfate, lanthanum iodide and lanthanum sulfide.

Cerium acetate, cerium bromate, cerium carbide, cerium nitride, cerium phosphide, cerium boride, cerium sulfide, cerium carbonate, cerium chloride, cerium fluoride, cerium nitrate, cerium selenate, cerium iodate, cerium iodide, cerium oxalate and cerium sulfate.

Praseodymium acetate, praseodymium bromate, praseodymium chloride, praseodymium fluoride, praseodymium selenate and praseodymium sulfate.

Neodymium acetate, neodymium carbide, neodymium bromate, neodymium bromide, neodymium chloride, neodymium fluoride, neodymium nitrate, neodymium sulfate.

Samarium acetate, samarium bromate, samarium fluoride, samarium chloride, samarium carbide and samarium sulfate.

Europium sulfate, europium carbide, europium chloride, europium nitride, europium nitrate and europium fluoride.

Gadolinium acetate, gadolinium bromide, gadolinium carbide, gadolinium chloride, gadolinium nitrate, gadolinium boride, gadolinium selenate, gadolinium phosphides, and gadolinium sulfate.

Terbium chloride, terbium fluoride, terbium nitrate and terbium sulfate.

Dysprosiun acetate, dysprosium bromate, dysprosium bromide, dysprosium chloride, dysprosium fluoride, dysprosium chromate, dysprosium nitrate, dysprosium oxalate, dysprosium selenate and dysprosiun sulfate.

Holmium bromide, holmium chloride, holmium iodide, holmium fluoride and holmium oxalate.

Erbium chloride, erbium fluoride, erbium nitrate, erbium boride and erbium sulfate.

Thulium chloride, thulium fluoride and thulium boride.

Ytterbium acetate, ytterbium titanate, ytterbium chloride, ytterbium fluoride, ytterbium carbide, ytterbium boride and ytterbium sulfate.

Lutetium sulfate, lutetium fluoride, lutetium carbide and lutetium boride.

Scandium bromide, scandium carbide, scandium chloride, scandium hydroxide, scandium nitride, scandium nitrate, scandium oxalate, scandium sulfate, scandium acetylacetonate and scandium fluoride.

Yttrium chloride, yttrium nitride, yttrium nitrate, yttrium sulfate, yttrium fluoride, yttrium carbide, yttrium sulfide and yttrium boride.

In addition, it is contamplated that various rare-earth minerals and derivatives thereof may be utilized such as Monazite, Altaite, Lanthanite, Parisite, Samarskite, Bastnaesite, Euxenite and Mischmetall.

In accordance with the practice of this invention, there is incorporated into the dielectric a beneficial amount of a source such as an oxide of at least one Actinide Series rare-earth selected from actinium, thorium, protactinium, uranium neptunium, plutonium, americium, curium, berkelium, californium, einsteinium, fermium, mendelevium, nobelium and lawrencium.

In addition, it is contemplated using element number 104 of this series, which is presently unnamed.

Typical Actinide rare-earth compounds include:

Thorium:
- Boride
- Bromide
- Carbide
- Carbonate
- Chloride
- Tetracyanoplatinate
- Fluoride
- Hydroxide
- Iodate
- Iodide
- Nitrate
- Nitride
- Oxalate
- Oxysulfide
- Selenate
- Silicide
- Sulfate Protactinium:
- Chloride
- Fluoride
- Bromide
- Iodide
- Boride Uranium:
- Boride
- Bromide
- Chloride
- Fluoride
- Hydride
- Iodide
- Nitride
- Sulfate
- Sulfide Neptunium:
- Bromide
- Chloride
- Fluoride
- Iodide
- Boride
- Sulfide Plutonium:
- Bromide
- Chloride
- Fluoride
- Nitrate
- Oxalate
- Sulfate Americium:
- Bromide
- Chloride
- Fluoride
- Iodide
- Boride Various Actinide rear-earth minerals and derivatives thereof may also be utilized including allanite, autunite, euxemite, gummite, monazile, etc.

Many of the Actinide rare earths are available in source in combination with other elements. It is contemplated using such sources, especially to take advantage of various properties such other elements.

Thus, although some members of the Actinide Series have not been isolated in the elemental state or as compounds, or have a very small half-life, it is contemplated that such may be used in combination with other elements in whatever form suitably available.

In one particular embodiment hereof, the Lanthanide or Actinide rare-earth source such as a salt or oxide is applied as one or more layers to the charge storage surface or face of the dielectric.

As used herein, the phrase "incorporated into" is intended to comprise any suitable means whereby a source (such as an oxide) of at least one rare-earth metal (Lanthanide or Actinide) is appropriately combined with the dielectric, such as by intimately adding or mixing the source including oxides into the dielectric pre-melt batch or to the melt; by ion exchange; by ion implantation; by diffusion techniques; or by applying one or more layers to the charge storage surface of the dielectric, or to the electrode contact surface of the dielectric, or as an internal layer within the dielectric.

The rare-earth source may be elemental in form or may be a suitable rare-earth compound, such as a rare-earth oxide or a rare-earth salt.

As used herein, the term "layer" is intended to be all inclusive of other similar terms, such as film, deposit, coating, finish, spread, covering, etc.

The rare-earth oxide or salt is applied to the dielectric surface (or a previously applied layer) by any convenient means including not by way of limitation vapor deposition; vacuum deposition; chemical vapor deposition; wet spraying upon the surface a mixture or solution of the oxide or salt layer substance suspended or dissolved in a liquid followed by evaporation of the liquid; dry spraying of the oxide or salt layers upon the surface; thermal evaporation using direct heat, electron beam or laser; plasma flame and/or arc spraying and/or deposition; and sputtering target techniques.

In one specific embodiment thereof, a layer of rare-earth oxide is applied to the dielectric charge storage surface by electron beam evaporation.

In still a further embodiment of this invention, a rare-earth oxide layer is formed in situ on the charge storage surface of the dielectric, such as by applying rare-earth metal to the surface followed by oxidation.

Each layer of rare-earth source is applied to the dielectric, as a surface of sub-layer, in an amount sufficient to obtain the desired beneficial result, usually to a thickness of at least about 100 angstrom units with a range of about 200 angstrom units per layer up to about 1 micron (10,000 angstrom units) per layer.

In the fabrication of a gaseous discharge panel, the dielectric material is typically applied to and cured on the surface (or face) of a supporting glass substrate or base (or slab) to which the electrode or conductor elements have been previously applied. The glass substrate may be of any suitable composition such as soda lime glass composition. Two glass substrates containing electrodes and cured dielectric are then appropriately sealed together, e.g., using thermal means, so as to form a panel.

In one preferred practice of this invention, each rare-earth oxide containing layer is applied to the surface of the cured dielectric before the panel heat sealing cycle, with the substrate temperature during rare-earth application ranging from about 150° F. to about 600° F.

In the practice of this invention, it has been discovered that the use of thin surface films of rare-earth oxides on each dielectric charge storage member surface provides several important advantages:

1. Such rare-earth oxide films are optically neutral in light transmission with low light absorption;

2. Such films have a low index of refraction providing low reflectivity in a multiple overcoat structure such as a rare-earth oxide layer over a barrier layer of aluminum oxide;

3. Such films do not darked as a result of prolonged discharge activity (panel aging);

4. The sesquioxides of the rare-earth oxide group ($La_2O_3$) as opposed to the dioxides ($CeO_2$) tend to provide minimum operating voltages within the general category of stable oxide insulators; that is, comparable to lead oxide layers as disclosed in U.S. Pat. No. 3,634,719. Ytterbium oxide ($Yb_2O_3$) and lanthanum oxide ($La_2O_3$) typically provide the lowest operating voltages, especially sustaining voltages; and 5. A properly prepared dielectric charge storage surface of rare-earth oxide provides stable operating voltages over extended periods of panel operation. In particular, ytterbium oxides exhibit long life properties.

In FIG. 1 of the drawing there is shown the aging characteristics for a multiple gas discharge display/memory panel of the Baker, et al. type. The panel comprises two opposing dielectric charge storage surfaces, each of which contains a thin (1000 angstrom units thick) film or layer of ytterbium oxide. After a brief preliminary aging period, both the maximum and minimum sustaining voltages substantially level off and become relatively constant for over 800 hours of panel operating time.

In FIG. 2 there is shown the aging characteristics for a display/memory panel containing ytterbium oxide (the same as the panel in FIG. 1) with performance results beyond 4000 hours. As in FIG. 1, there is a substantial leveling off of both the maximum and minimum sustaining voltages after a brief preliminary aging period.

In both FIGS. 1 and 2 the reduction in operation voltages is about 25 volts below panels containing no dielectric overcoat. This is significant since it enhances the economics of the panel electronics.

Other rare earth oxides, e.g., $Y_2O_3$, $La_2O_3$, also exhibit the same typical reduction in panel operating voltages as $Yb_2O_3$, relative to panels containing non-coated dielectrics.

From the practice of this invention, it is also possible to use reduced gas fill pressure to gain other operational advantages, such as increased brightness, without sacrificing life characteristics. Non-overcoated panels and some other overcoat materials will not allow reduced pressure due to reduced life.

Reduced pressures are especially necessary for operation at high altitudes.

In addition to the foregoing advantages, it is anticipated that some of the rare-earth oxides will provide inherent ion or other barrier protection, thereby eliminating the use of other barrier films or layers.

The use of a rare-earth oxide, in accordance with this invention also has many other potential beneficial results.

For example, a radioactive, rare-earth oxide may be used to condition the ionizable gas medium of the gas discharge display/memory device; that is provide free electrons within the gas such that the discharge can be initiated.

In addition, the rare-earth oxide may be used as a luminescent agent, especially as a photoluminescent phosphor.

The rare-earth activated phosphors are well known in the prior art. Typical phosphors include europium-activated yttrium vanadate red phosphor, e.g., with one europium atom to every 19 yttrium atoms and europium activated, yttrium oxide.

Also the rare-earth oxides exhibit interesting electrical properties, including semi-conductor characteristics, which make such oxides particularly suitable for use at the gaseous medium interface.

Likewise, a rare-earth oxide may be utilized in combination with one or more compounds of other elements, such as oxides of Group IIA, Al, Si, Ti, Zr, Hf, Pb, etc., to achieve various results, e.g., lowering operating voltages, thermal stability, decreased aging cycle time, more uniform operating voltages, etc.

DRAWINGS ILLUSTRATING GAS DISCHARGE DISPLAY/MEMORY PANEL

Reference is made to the accompanying drawings and the hereinafter discussed FIGS. 3 to 6 shown thereon illustrating a gas discharge display/memory panel of the Baker, et al. type.

Figure 1:
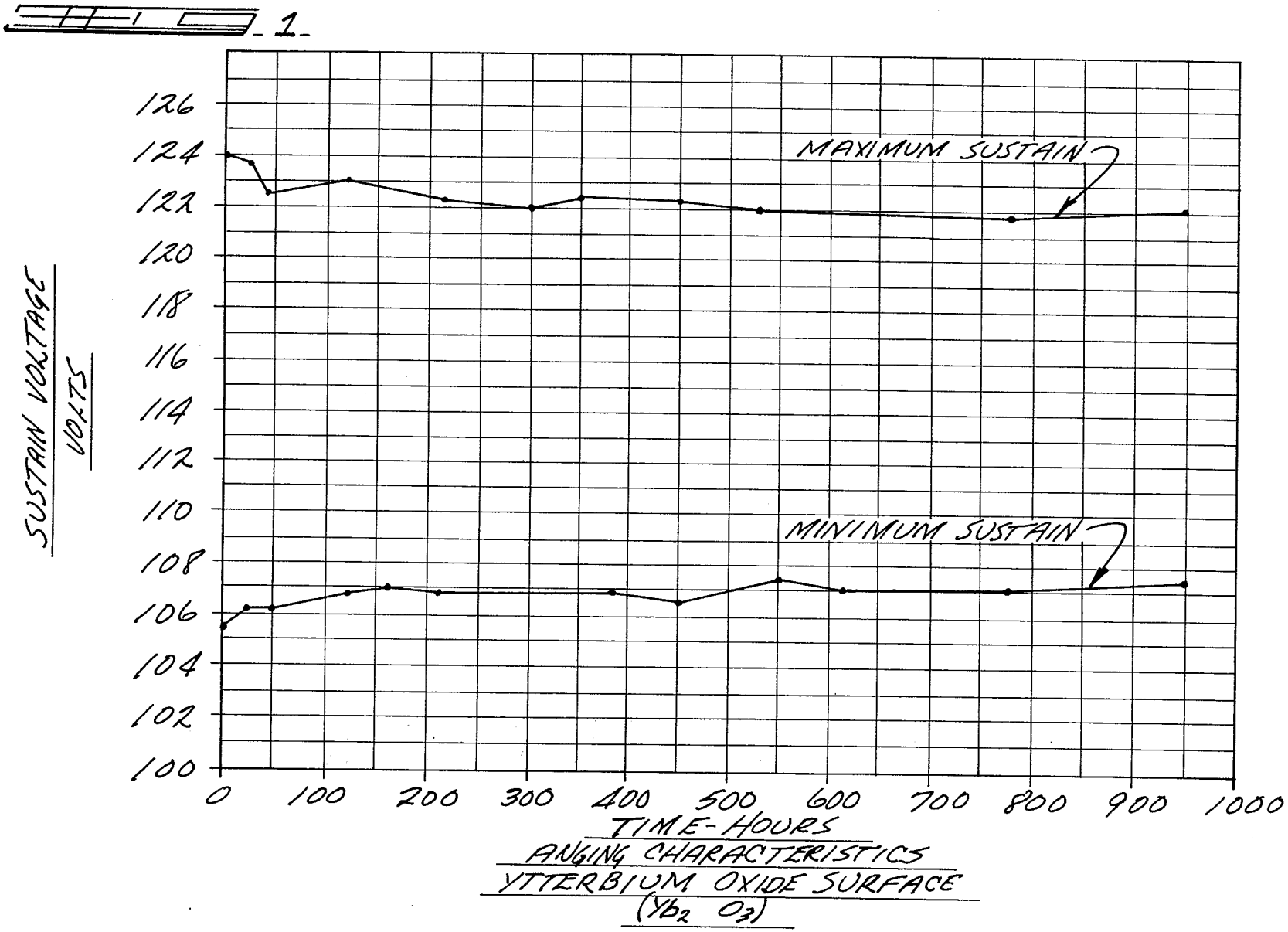
FIGS. 1 and 2 are discussed above.
Figure 2:
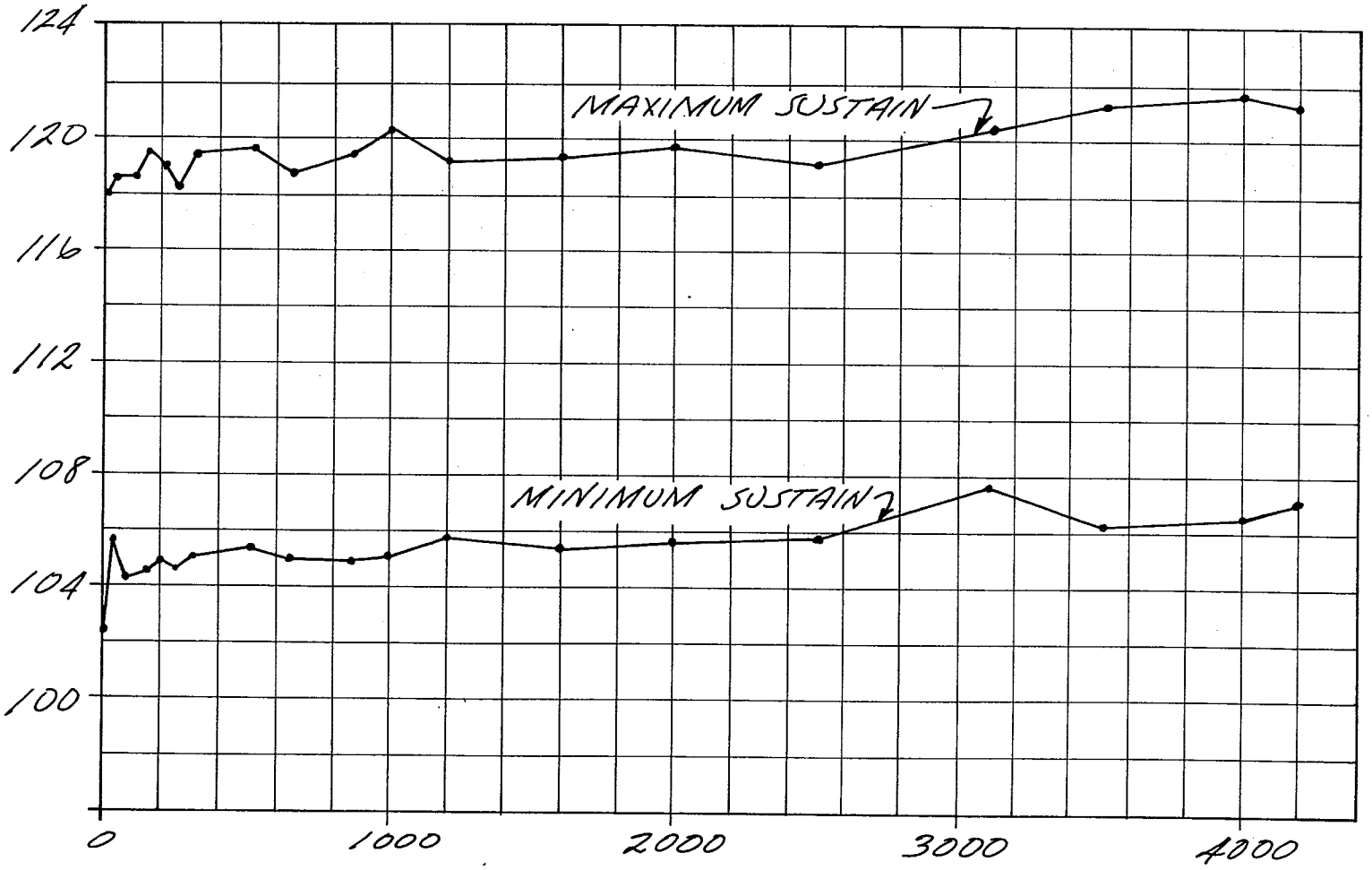
Figure 4:
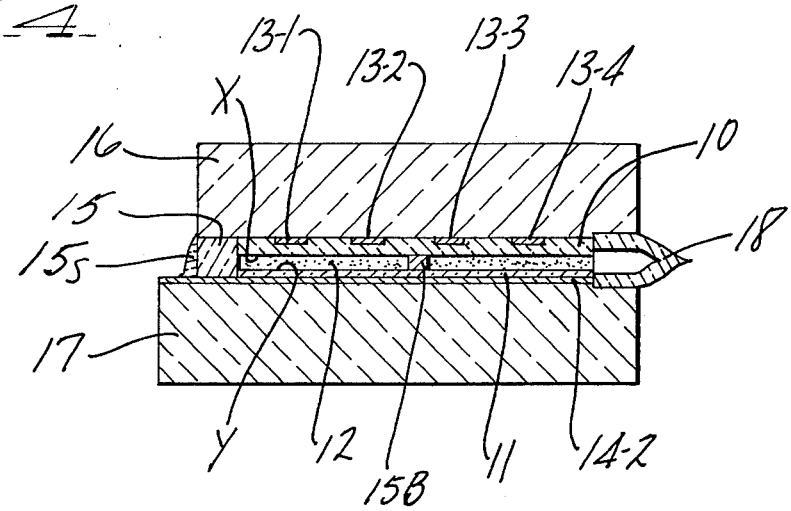
FIG. 4 is a cross-sectional view (enlarged, but not to proportional scale since the thickness of the gas volume, dielectric members and conductor arrays have been enlarged for purposes of illustration) taken on lines 2—2 of FIG. 3.
Figure 3:
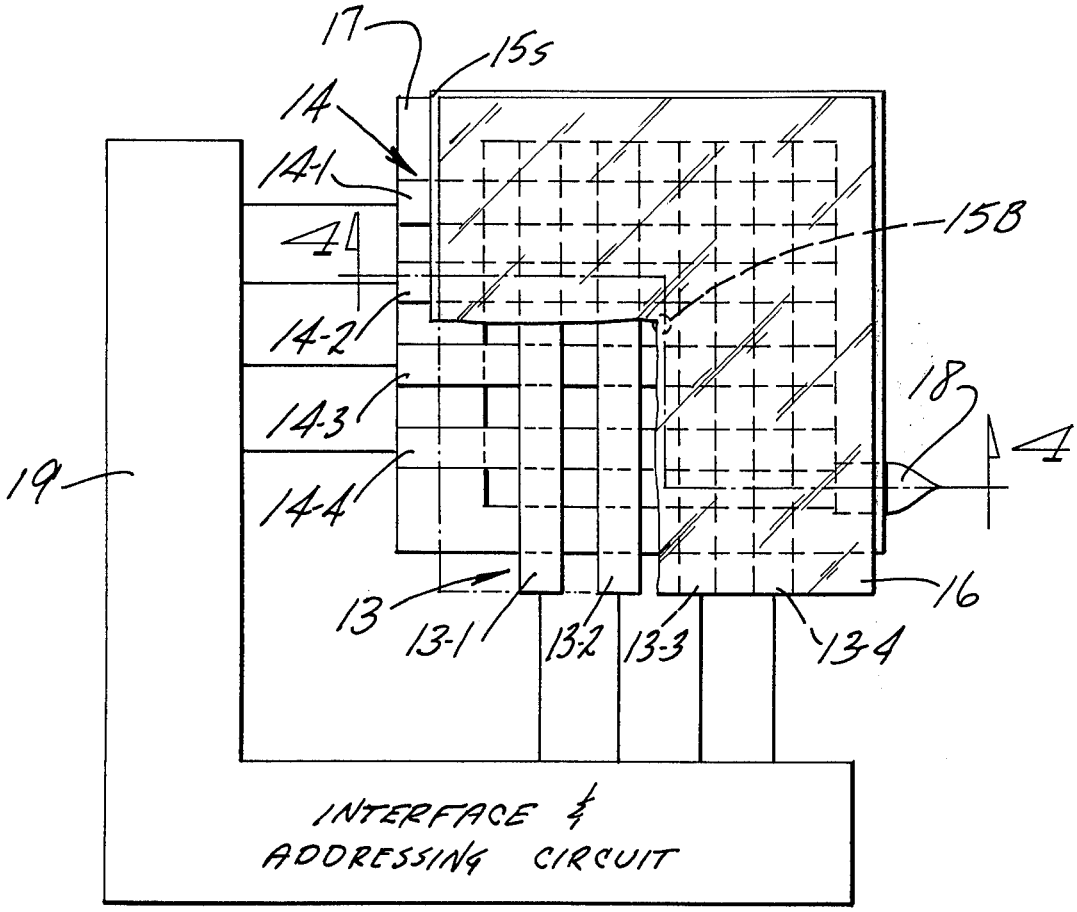
FIG. 3 is a partially cut-away plan view of a gaseous discharge display/memory panel as connected to a diagrammatically illustrated source of operating potentials.

The invention utilizes a pair of dielectric films 10 and 11 separated by a thin layer or volume of a gaseous discharge medium 12, the medium 12 producing a copious supply of charges (ions and electrons) which are alternately collectable on the surfaces of the dielectric members at opposed or facing elemental or discrete areas X and Y defined by the conductor matrix on non-gas-contacting side of the dielectric members, each dielectric member presenting large open surface areas, and a plurality of pairs of elemental X and Y areas. While the electrically operative structural members such as the dielectric members 10 and 11 and conductor matrixes 13 and 14 are all relatively thin (being exaggerated in thickness in the drawings) they are formed on and supported by rigid nonconductive support members 16 and 17 respectively.

Preferably, one or both of the nonconductive support members 16 and 17 pass light produced by discharge in the elemental gas volumes. Preferably, they are transparent glass members. These members essentially define the overall thickness and strength of the panel. For example, the thickness of gas layer 12 as determined by spacer 15 is usually under 10 mils and preferably about 3 to 8 mils, dielectric layers 10 and 11 (over the conductors at the elemental or discrete X and Y areas) are usually between 0.1 and 2 mils thick, and conductors 13 and 14 at least about 1,000 angstroms thick. However, support members 16 and 17 are much thicker (particularly in larger panels) so as to provide as much ruggedness as may be desired to compensate for stresses in the panel. Support members 16 and 17 also serve as heat sinks for heat generated by discharges and thus minimize the effect of temperature on operation of the device. If it is desired that only the memory function be utilized, then none of the members need be transparent to light.

The electrical properties of support members 16 and 17 are not critical so long as the electrodes are appropriately insulated from one another. The main function of support members 16 and 17 is to provide mechanical support and strength for the entire panel, particularly with respect to pressure differential acting on the panel. Ordinary ¼ inch commercial grade soda lime plate glasses have been used for this purpose. Other glasses such as low expansion glasses or devitrified glass can be used provided they can withstand processing.

Spacer 15 may be made of the same glass material as dielectric films 10 and 11 and may be an integral rib formed on one of the dielectric members and fused to the other members to form a bakeable hermetic seal enclosing and confining the ionizable gas volume 12. However, a separate final hermetic seal may be effected by a high strength devitrified glass sealant 15S. Tubulation 18 is provided for exhausting the space between dielectric members 10 and 11 and filling that space with the volume of ionizable gas. For large panels small beadlike solder glass spacers such as shown at 15B may be located between conductor intersections and fused to dielectric members 10 and 11 to aid in withstanding stress on the panel and maintain uniformity of thickness of gas volume 12.

Conductor arrays 13 and 14 may be formed on support members 16 and 17 by a number of well-known processes, such as photoetching, vacuum deposition, stencil screening, etc. In the panel shown in FIG. 6, the center-to-center spacing of conductors in the respective arrays is about 17 mils for one typical commercial configuration. Transparent or semi-transparent conductive material such as tin oxide, gold, or aluminum can be used to form the conductor arrays and should have a resistance less than 3000 ohms per line. Alternately, narrow opaque electrodes may be used so that discharge light passes the edges of the electrodes to reach the viewer. It is important to select a conductor material that is not attacked during processing by the dielectric material.

It will be appreciated that conductor arrays 13 and 14 may be wires of filaments of copper, gold, silver or aluminum or any other conductive metal or material. For example 1 mil wire filaments are commercially available and may be used in the invention. However, formed in situ conductor arrays are preferred since they may be more easily and uniformly placed on and adhered to the support plates 16 and 17.

Dielectric layer members 10 and 11 are formed of an inorganic material and are preferably formed in situ as an adherent film or coating which is not chemically or physically affected during bake-out of the panel. One such material is a solder glass such as Kimble SG-68 manufactured by and commercially available from the assignee of the present invention.

This glass has thermal expansion characteristics substantially matching the thermal expansion characteristics of certain soda-lime glasses, and can be used as the dielectric layer when the support members 16 and 17 are soda-lime glass plates. Dielectric layers 10 and 11 should have a dielectric breakdown voltage of about 1000 v. and be electrically homogeneous of a microscopic scale (e.g., no cracks, bubbles, dirt, surface films, etc.). In addition, the gas contacting surfaces of dielectric layers 10 and 11 should be good photoemitters of electrons in a baked out condition. In one practice of this invention, the surfaces of dielectric layers 10 and 11 are overcoated with at least one rare earth oxide, as already described herein. Of course, for an optical display at least one of dielectric layers 10 and 11 should pass light generated on discharge and be transparent or translucent and, preferably, both layers are optically transparent.

The preferred spacing between the facing surfaces of the two dielectric films is about 3 to 8 mils if the conductor arrays 13 and 14 have center-to-center spacing of about 17 mils.

The ends of conductors 14-1 . . . 14-4 and support members 17 extend beyond the enclosed gas volume 12 and are exposed for the purpose of making electrical connection to interface and addressing circuitry 19. Likewise, the ends of conductors 13-1 . . . 13-4 on support member 16 extend beyond the enclosed gas volume 12 and are exposed for the purpose of making electrical connection to interface and addressing circuitry 19.

As in known display systems, the interface and addressing circuitry or system 19 may be relatively inexpensive line scan systems or the somewhat more expensive high speed random access systems. In either case, it is to be noted that a lower amplitude of operating potentials helps to reduce problems associated with the interface circuitry between the addressing system and the display/memory panel, per se. In addition, by providing a panel having greater uniformity in discharge characteristics throughout the panel, manufacturing tolerances of the interfacing circuitry can be made less rigid.

One mode of initiating operation of the panel will be described with reference to FIG. 5, which illustrates the condition of one elemental gas volume 30 having an elemental cross-sectional area and volume which is quite small relative to the entire volume and cross-sectional area of gas 12. The cross-sectional area of volume 30 is defined by the overlapping common elemental areas of the conductor arrays and the volume is equal to the product of the distance between the dielectric surfaces and the elemental area. It is apparent that if the conductor arrays are uniform and linear and are orthogonally (at right angles to each other) related each of elemental areas X and Y will be squares and if conductors of one conductor array are wider than conductors of the other conductor arrays, said areas will be rectangles. If the conductor arrays are at transverse angles relative to each other, other than 90°, the areas will be diamond shaped so that the cross-sectional shape of each volume is determined solely in the first instance by the shape of the common area of overlap between conductors in the conductor arrays 13 and 14. The dotted lines 30' are imaginary lines to show a boundary of one elemental volume about the center of which each elemental discharge takes place. It is known that the cross-sectional area of the discharge in a gas is affected by, inter alia, the pressure of the gas, such that, if desired, the discharge may even be constricted to within an area smaller than the area of conductor overlap. By utilization of this phenomena, the light production may be confined or resolved substantially to the area of the elemental cross-sectional area defined by conductor overlap. Moreover, by operating at such pressure charges (ions and electrons) produced on discharge are laterally confined so as to not materially affect operation of adjacent elemental discharge volumes.

Figure 5:
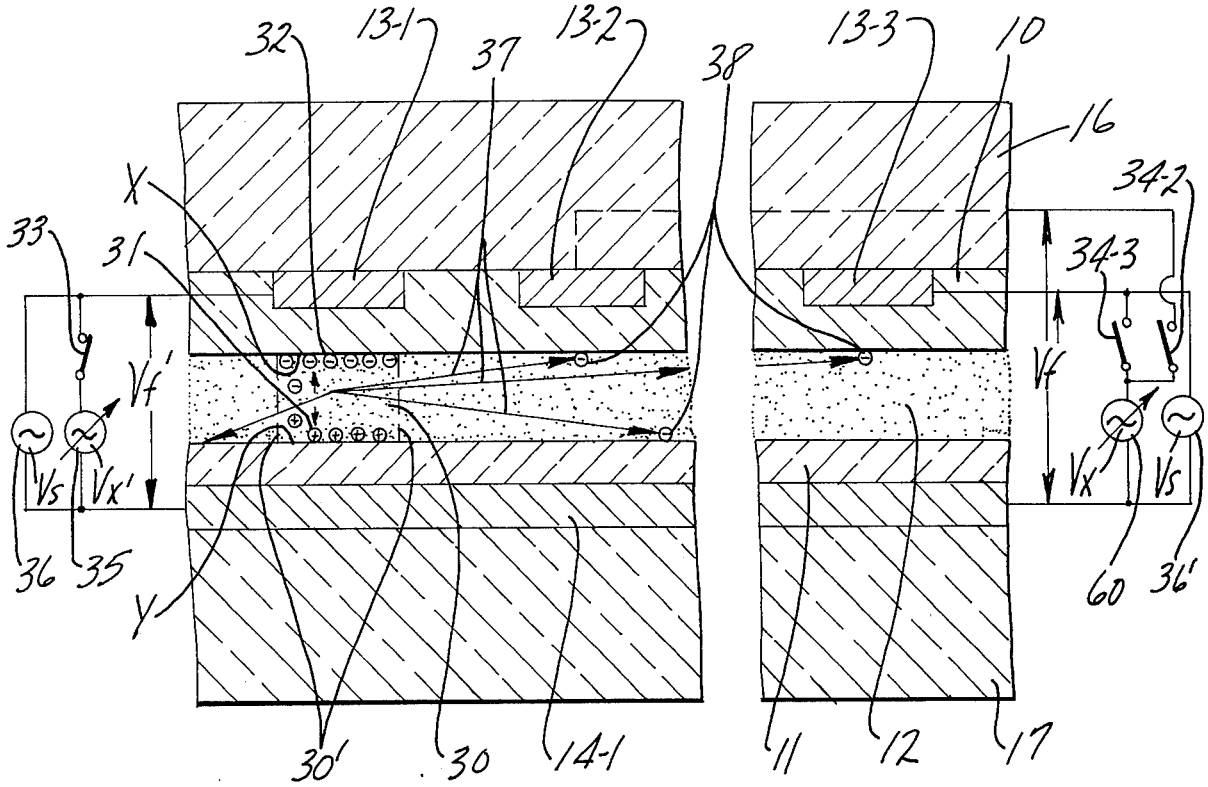
FIG. 5 is an explanatory partial cross-sectional view similar to FIG. 4 (enlarged, but not to proportional scale).

In the instance shown in FIG. 5, a conditioning discharge about the center of elemental volume 30 has been initiated by application to conductor 13-1 and conductor 14-1 firing potential $V_x'$ as derived from a source 35 of variable phase, for example, and source 36 of sustaining potential $V_s$ (which may be a sine wave, for example). The potential $V_x'$ is added to the sustaining potential $V_s$ as sustaining potential $V_s$ increases in magnitude to initiate the conditioning discharge about the center of elemental volume 30 shown in FIG. 5. There, the phase of the source 35 of potential $V_x'$ has been adjusted into adding relation to the alternating voltage from the source 36 of sustaining voltage $V_s$ to provide a voltage $V_f'$, when switch 33 has been closed, to conductors 13-1 and 14-1 defining elementary gas volume 30 sufficient (in time and/or magnitude) to produce a light generating discharge centered about discrete elemental gas volume 30. At the instant shown, since conductor 13-1 is positive, electrons 32 have collected on and are moving to an elemental area of dielectric member 10 substantially corresponding to the area of elemental gas volume 30 and the less mobile positive ions 31 are beginning to collect on the opposed elemental area of dielectric member 11 since it is negative. As these charges build up, they constitute a back voltage opposed to the voltage applied to conductors 13-1 and 14-1 and serve to terminate the discharge in elemental gas volume 30 for the remainder of a half cycle.

During the discharge about the center of elemental gas volume 30, photons are produced which are free to move or pass through gas medium 12, as indicated by arrows 37, to strike or impact remote surface areas of photoemissive dielectric members 10 and 11, causing such remote areas to release electrons 38. Electrons 38 are created in every other discrete elemental gas volumes, and condition these volumes for operation at a firing potential $V_f$ which is lower in magnitude than the firing potential $V_f'$ for the initial discharge.

Thus, elimination of physical obstructions or barriers between discrete elemental volumes permits photons to travel via the space occupied by the gas medium 12 to remote surface areas of dielectric members 10 and 11 and provides a mechanism for supplying free electrons to all elemental gas volumes, thereby conditioning all discrete elemental gas volumes for subsequent discharges, respectively, at a substantially uniform lower applied potential. While in FIG. 5 a single elemental volume 30 is shown, it will be appreciated that an entire row (or column) of elemental gas volumes may be maintained in a "fired" condition during normal operation of the device with the light produced thereby being masked or blocked off from the normal viewing area and not used for display purposes. It can be expected that in some applications there will always be at least one elemental volume in a "fired" condition and producing light in a panel, and in such applications it is not necessary to provide separate discharge or generation of photons for purposes described earlier.

However, as described earlier, the entire gas volume can be conditioned for operation at uniform firing potentials by use of external or internal radiation so that there will be no need for a separate source of higher potential for initiating an initial discharge. Thus, by irradiating the panel with ultraviolet radiation or by including a radioactive material within the glass materials or gas space, all discharge volumes can be operated at uniform potentials from addressing and interface circuit 19.

Since each discharge is terminated upon a build-up or storage of charges at opposed pairs of elemental areas, the light produced is likewise terminated. In fact, light production lasts for only a small fraction of a half cycle of applied alternating potential and, depending on design parameters, is typically in the submicrosecond range.

After the initial firing or discharge of discrete elemental gas volume 30 by a firing potential $V_f'$, switch 33 may be opened so that only the sustaining voltage $V_s$ from source 36 is applied to conductors 13-1 and 14-1. Due to the storage of charges at the opposed elemental areas X and Y, the elemental gas volume 30 will discharge again at or near the peak of the following half cycle of $\hat{V}_s$ (which is of opposite polarity) to again produce a momentary pulse of light. At this time, due to reversal of field direction, electrons 32 will collect on and be stored on elemental surface area Y of dielectric member 11 and positive ions 31 will collect and be stored on elemental surface area X of dielectric member 10. After a few cycles of sustaining voltage $V_s$, the times of discharges become symmetrically located with respect to the wave form of sustaining voltage $V_s$. At remote elemental volumes, as for example, the elemental volumes defined by conductor 14-1 with conductors 13-2 and 13-3, a uniform magnitude or potential $V_x$ from source 60 is selectively added by one or both of switches 34-2 or 34-3 to the sustaining voltage $V_s$, shown as 36', to fire one or both of these elemental discharge volumes. Due to the presence of free electrons produced by photons from the discharge centered about elemental volume 30, each of these remote discrete elemental volumes have been conditioned for operation at uniform firing potential $V_f$.

In order to turn "off" an elemental gas volume (i.e., terminate a sequence of discharges representing the "on" state), the sustaining voltage may be removed. However, since this would also turn "off" other elemental volumes along a row or column, it is preferred that the volumes be selectively turned "off" by application to selected "on" elemental volumes a voltage which can neutralize the charges stored at the pairs of opposed elemental areas.

This can be accomplished in a number of ways, as for example, varying the phase or time position of the potential from source 60 to where that voltage combined with the potential from source 36' falls substantially below the sustaining voltage.

It is apparent that the plates 16-17 need not be flat but may be curved, curvature of facing surfaces of each plate being complementary to each other, so that the gap between plates remains substantially uniform over their entire surfaces. While the preferred conductor arrangement is of the crossed grid type as shown herein, it is likewise apparent that where an infinite variety of two dimentional display patterns are not necessary, as where specific standardized visual shapes (e.g., numerals, letters, words, etc.) are to be formed and image resolution is not critical, the conductors may be shaped accordingly. Reference is made to British patent specification No. 1,302,148 and U.S. Pat. No. 3,711,733, wherein non-grid electrode arrangements are illustrated.

Figure 6:
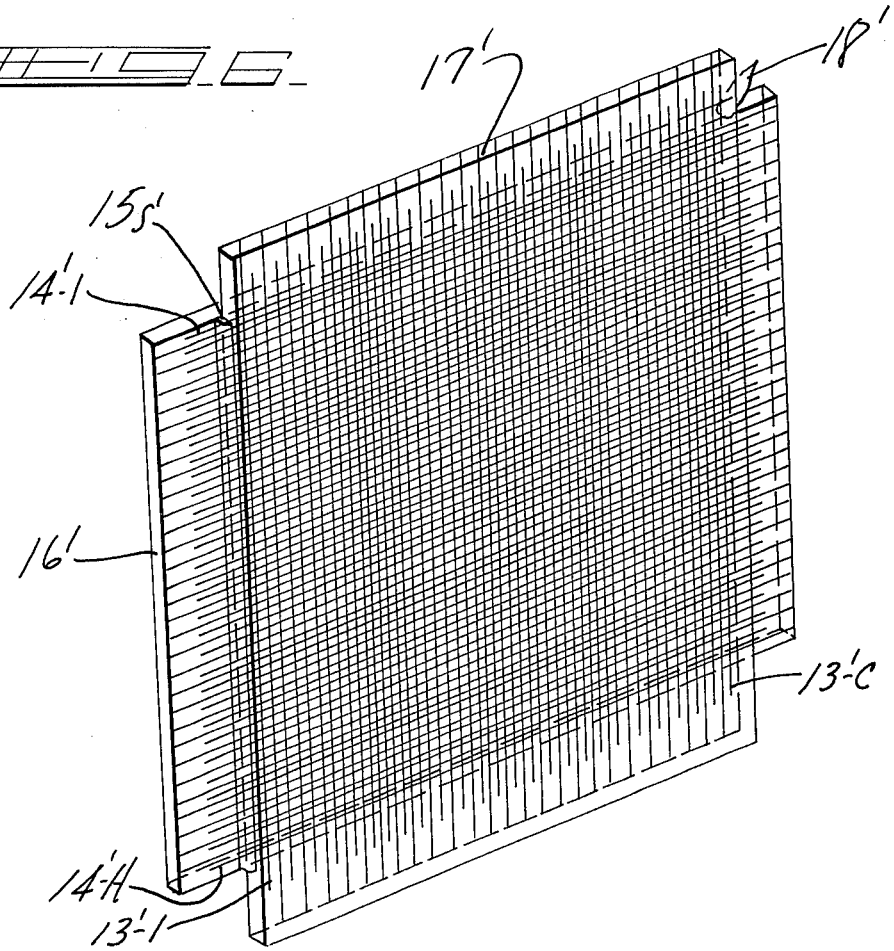
FIG. 6 is an isometric view of a gaseous discharge display/memory panel.

The device shown in FIG. 6 is a panel having a large number of elemental volumes similar to elemental volume 30 (FIG. 5). In this case more room is provided to make electrical connection to the conductor arrays 13' and 14', respectively, by extending the surfaces of support members 16' and 17' beyond seal 15S', alternate conductors being extended on alternative sides. Support members 16' and 17' are transparent. The dielectric coatings are not shown in FIG. 6 but are likewise transparent so that the panel may be viewed from either side.

Figure 7:
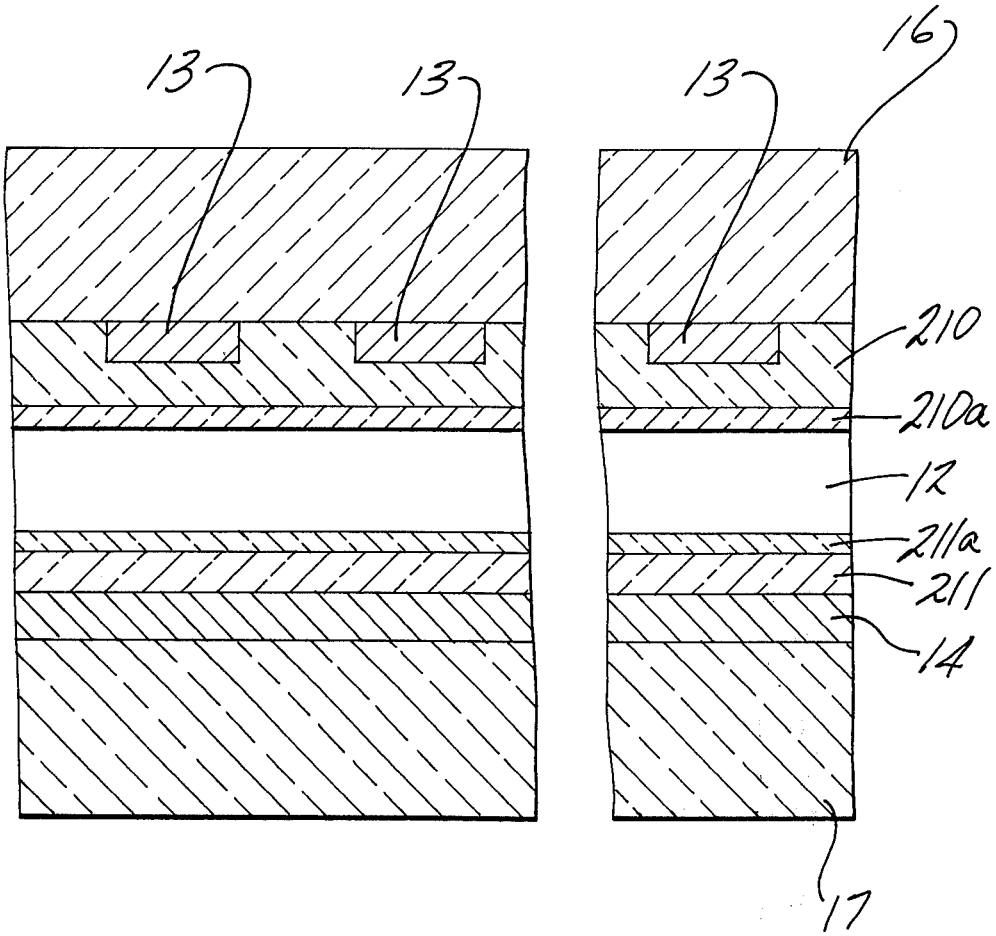
FIGs. 7, 8 and 9 are discussed at the end of this specification.

FIG. 7 illustrates one preferred embodiment of this invention utilizing a cross-sectional view as in FIG. 6.

In FIG. 7 there is illustrated substrates 16 and 17, electrodes 13 and 14, dielectric members 210 and 211, gaseous medium 12, and dielectric rare-earth oxide overcoats **210*a* and 211*a***.

Although not illustrated in FIG. 7, additional dielectric overcoats or undercoats of other selected materials may be used below or above dielectric rare-earth oxide overcoats **210*a* and 211*a***. These overcoats or undercoats may be continuous or discontinuous.

In another embodiment of this invention, each dielectric member (210 or 211) is comprised of at lest three separate layers with one or more layers (bottom, middle or top) being composed of a rare earth oxide.

Figure 8:
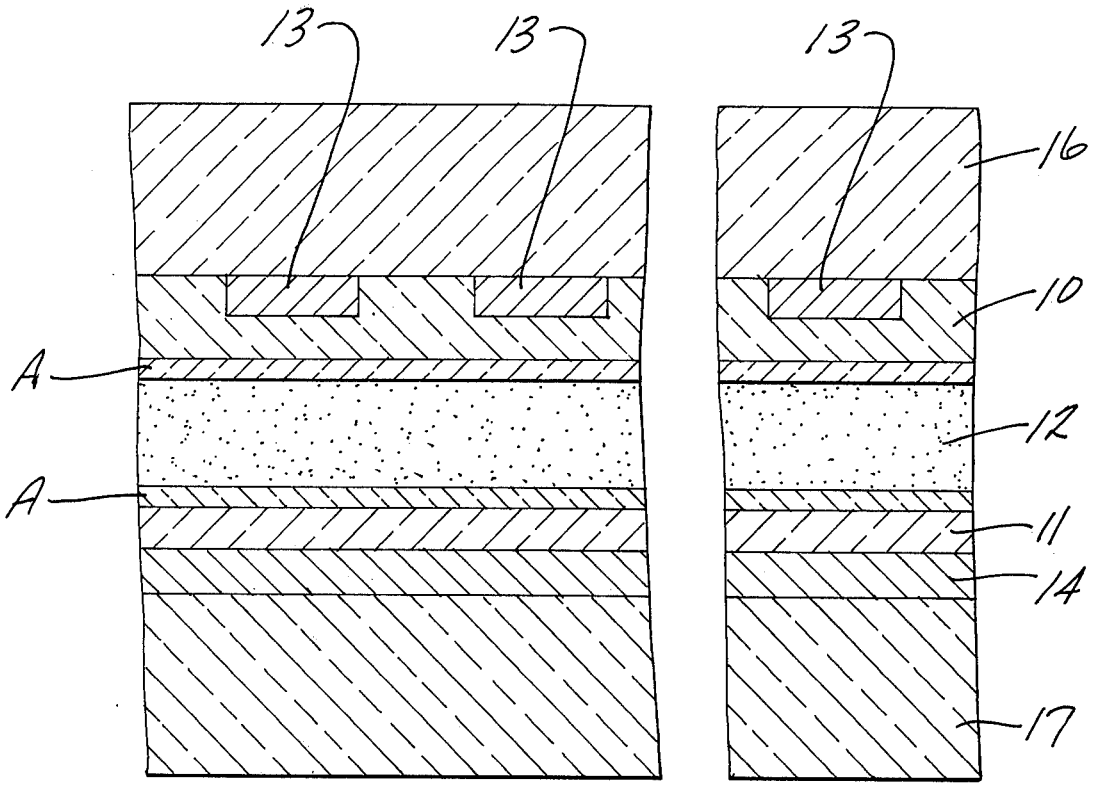
Figure 9:
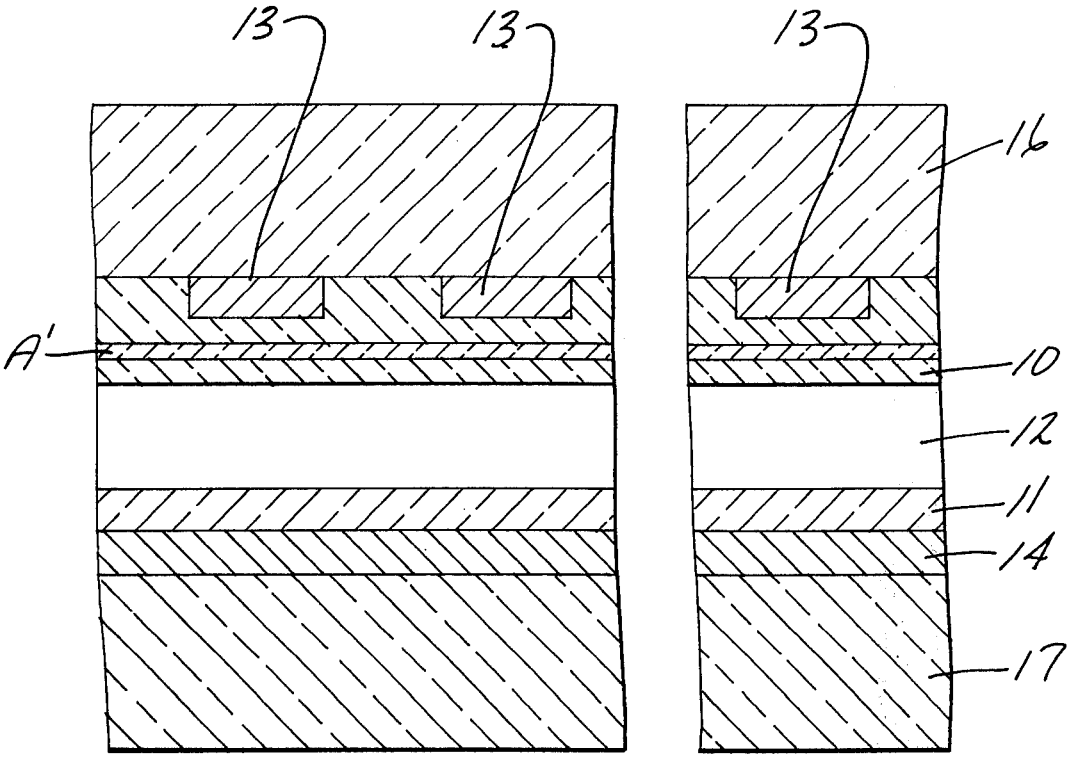

As seen in the drawings, FIGS. 8 and 9, respectively, show the Actinide rare earth material is contained in a layer on the surface of the dielectric member or in an internal layer within the dielectric member.

As shown in FIG. 8, the Actinide rare earth oxide material is contained within layer A on the surface of dielectric members 10 and 11, and, as shown in FIG. 9, the Actinide rare earth oxide material is contained within an internal layer "A" within the dielectric members 10 and 11.

What is claimed is:

1. A gas discharge display panel comprising two insulating slabs which are sealed along their peripheries, in order to form a sealed enclosure between their opposing faces, said enclosure being filled with ionizable gas, and two crossed networks of orthogonal electrodes arranged onto the opposing faces of said slabs, said opposing faces being covered with a layer of material containing an oxide of a metal of the lanthanide or actinide families.

2. A display panel as claimed in claim 1, wherein said layer is a film of thorium oxide or gadolinium oxide.

3. A display panel as claimed in claim 2, wherein said oxide film is a thin film deposited upon a film of a dielectric material such as an enamel, itself deposited upon said opposite faces of said slabs.

4. A display panel as claimed in claim 1, wherein said layer is a film of a dielectric material comprising a small quantity of thorium oxide or gadolinium oxide.

5. A gas discharge display panel comprising two insulating slabs which are sealed along their peripheries, in order to form a sealed enclosure between their opposing faces, and enclosure being filled with ionizable gas, and two crossed networks of orthogonal electrodes arranged onto the opposing faces of said slabs, said opposing faces being covered with a layer of material containing an oxide of a metal of the lanthanide family.

6. A display panel as claimed in claim 5, wherein said layer is a film of gadolinium oxide.

7. A display panel as claimed in claim 6, wherein said oxide film is a thin film deposited upon a film of a dielectric material such as an enamel, itself deposited upon said opposite faces of said slabs.

8. A display panel as claimed in claim 5, wherein said layer is a film of a dielectric material comprising a small quantity of gadolinium oxide.

9. A gas discharge display panel comprising two insulating slabs which are sealed along their peripheries, in order to form a sealed enclosure between their opposing faces, said enclosure being filled with ionizable gas, and two crossed networks of orthogonal electrodes arranged onto the opposing faces of said slabs, said opposing faces being covered with a layer of material containing an oxide of a metal of the actinide family.

10. A display panel as claimed in claim 9, wherein said layer is a film of thorium oxide.

11. A display panel as claim in claim 10 wherein said oxide film is a thin film deposited upon a film of a dielectric material such as an enamel, itself deposited upon said opposite faces of said slabs.

12. A display panel as claim in claim 9, wherein said layer is a film of a dielectric material comprising a small quantity of thorium oxide.

* * * * *